United States Patent [19]

Doty et al.

[11] 4,035,227

[45] July 12, 1977

[54] METHOD FOR TREATING PLASTIC SUBSTRATES PRIOR TO PLATING

[75] Inventors: Warren R. Doty, Royal Oak; Timothy J. Kinney, Berkley, both of Mich.

[73] Assignee: Oxy Metal Industries Corporation, Warren, Mich.

[21] Appl. No.: 574,191

[22] Filed: May 2, 1975

Related U.S. Application Data

[63] Continuation-in-part of Ser. No. 399,674, Sept. 21, 1973, abandoned.

[51] Int. Cl.[2] ..... H01B 3/18

[52] U.S. Cl. ..... 156/668; 427/306; 427/307

[58] Field of Search ..... 156/3, 18, 668, 902; 427/98, 304, 305, 306, 307; 106/1; 252/79.2, 79.3; 204/47, 48, 49

[56] References Cited

U.S. PATENT DOCUMENTS

| | | | |
|---|---|---|---|
| 3,011,920 | 12/1961 | Shipley | 252/472 |
| 3,471,376 | 10/1969 | Saubestre et al. | 427/307 |
| 3,480,523 | 11/1969 | Tyrrell | 204/47 |
| 3,669,851 | 6/1972 | Garvey | 204/49 |
| 3,790,400 | 2/1974 | Kuzmik | 106/1 |
| 3,790,454 | 2/1974 | Henderson et al. | 204/49 |
| 3,873,357 | 3/1975 | Lando | 106/1 |
| 3,901,773 | 8/1975 | Ludwig | 204/48 |
| 3,982,054 | 9/1976 | Feldstein | 427/304 |
| 3,993,801 | 11/1976 | Feldstein | 427/306 |
| 3,993,848 | 11/1976 | Feldstein | 427/304 |

*Primary Examiner*—Charles E. Van Horn
*Assistant Examiner*—Jerome W. Massie
*Attorney, Agent, or Firm*—B. F. Claeboe

[57] ABSTRACT

The present invention is directed to a process and composition for accelerating the activation of a polymeric surface prior to the electroless plating thereof, wherein there is employed a solution comprising a relatively dilute inorganic acid and a metal salt desirably selected from the group consisting of nickel, cobalt and ruthenium. There may also be employed a compound cabable or ionizing to produce a source of fluoride ions. By so proceeding, microscopic cavities in the polymeric substrate are thoroughly cleansed of residual tin ions which remain subsequent to rinsing of the polymeric body following the conventional activation step employing an acidic solution of pollodium chloride and stannous chloride. The removal of palladium ions, which have a catalytic effect in the electroless plating operation, is minimized by the composition and process of this invention, and further, in addition to other advantages, there is achieved relatively low and uniform values of part resistance and contact resistance.

2 Claims, No Drawings

METHOD FOR TREATING PLASTIC SUBSTRATES PRIOR TO PLATING

CROSS REFERENCE TO RELATED CASES

This application is a continuation-in-part of application Ser. No. 399,674 filed Sept. 21, 1973, and now abandoned.

BACKGROUND OF THE INVENTION

It is known in the art to which this invention pertains that plastic parts prior to electroless plating and subsequent electroplating are pre-treated by a sequence of steps basically plating.

In the accelerating step, to which the instant invention is particularly directed, it has been proposed after activation and before metallization to employ a solution which will remove the excess stannous hydroxide from the substrate surface. Typical examples of such solutions are dilute acids such as perchloric acid, sulfuric acid or phosphoric acid, and alkaline materials such as sodium hydroxide, sodium carbonate or sodium pyrophosphate.

It has also been suggested by the prior art that more readily controllable acceleration can be accomplished with the use of an acidic dilute palladium chloride solution following activation. It has been found, however, that the effectiveness of the accelerator solution just mentioned is impeded by trace amounts of hexavalent chromium ion carried by the substrate from the prior etching operation, and in an endeavor to rectify this condition it has been proposed to control the hexavalent chromium ion contamination of the accelerating solution by the periodic addition of a suitable source of stannous ions, to thereby effect a conversion of the hexavalent chromium to the trivalent condition.

However, in none of the known literature references is there revealed the successful accomplishment of an essentially complete removal of the stannous hydroxide which results from the water rinse following activation, and at the same time substantially zero removal of the palladium hydroxide also formed by the water rinse. As was stated, the palladium ions are requisite for their catalytic reactive potential in the subsequent electroless plating step.

SUMMARY OF THE INVENTION

The instant inventive concept is particularly directed to a method and composition effective to accelerate the surfaces of a polymeric substrate subsequent to the activation thereof and prior to electroless plating, the accelerating solution promoting the removal of the stannous ions which are codeposited with palladium during the activating step, the accelerator being possessed of the property of activating the stainless steel rack contacts, whereby an immersion deposit of a metal catalytic to the subsequent electroless metallization solution is formed thereon.

An accelerating solution as provided by this invention basically comprises specified molar concentrations of a relatively dilute inorganic acid and a metal salt desirably selected from the group consisting of nickel, cobalt and ruthenium. More specifically, the inorganic acid is relatively dilute hydrochloric acid, fluoboric acid, sulfuric acid or equivalents or mixtures thereof. A preferred metal salt meeting the requirements just mentioned is nickel chloride, although there may be used cobalt chloride, ruthenium chloride or any salt from the platinum group of the Periodic Chart and which has a reduction potential less than that of iron.

It is also an important function of an accelerator solution to prevent the re-immersion of dissolved tin ions on the accelerated plastic. During rinsing following activation, primarily due to oxygen dissolved in the rinse water, or during subsequent transfer of the activated and rinsed plastic surface through the air, it is frequently found that a particular portion of the stannous ions retained on the plastic surface are oxidized to the stannic state. In aqueous solutions, these stannic ions rather quickly assume what has been referred to in the prior art as being in a colloidal form. The stannic colloid is very powerful and has heretofore been unrecoginzed as an agent in inhibiting or precluding the catalytic effect of the adsorbed palladium ions on the subsequent electroless metallization solution. In a significant number of cases, a sufficiently high ionic strength of the inorganic acid or acid salt is sufficient to counteract the deleterious effect of the re-immersed stannic ion. In a relatively few particularly severe instances, however, it may be desirable and even advantageous to make an addition to the acidic accelerator of a compound having the capability of ionizing in order to serve as a source of fluoride ions. Among the compounds suitable for this purpose are hydrofluoric acid, sodium fluoride, sodium acid fluoride, ammonium acid fluoride, ammonium fluoride, lithium fluoride, potassium acid fluoride and fluosilic acid. The action of acidic accelerators based on the concepts of the instant invention will be more fully understood when reference is made to the examples appearing hereinafter.

By proceeding in accordance with this invention, excess stannous hydroxide from the activating step is removed from the microscopic cavities in the polymeric surface, the stannous hydroxide being the result of a hydrolysis reaction when the plastic part is rinsed with water after the activating step.

Hydrolysis of the palladium chloride also occurs during the water rinsing step, with consequent formation of palladium hydroxide. Palladium ions have a catalytic effect in the subsequent electroless nickel plating operation, whereas the stannous ions are not catalytic. By this invention, there is achieved selective removal of the stannous ions from the palladium ions by the use, under carefully controlled time and temperature conditions, of a solution which at present preferably comprises relatively dilute hydrochloric acid, nickel chloride hexahydrate and sodium bifluoride.

DESCRIPTION OF PREFERRED EMBODIMENT

In a typical chemical plating procedure for polymeric plastic substrates, the plastic part may be first cleaned of surface grime and the like in an aqueous alkali soak solution, the cleaned part may then be contacted with an organic solvent medium which can be either a single-phase system or an admixed water-organic solvent emusion, and thereafter followed with a thorough water rinse of the part. The part is then contacted with an aqueous acid solution containing hexavalent chromium ions to etch the surface of the plastic, followed by one or more rinses in water and/or solutions containing chromium-reducing or chromium-extracting agents. The surface of the substrate is then contacted with an acid tin-palladium complex which generally is an activator containing palladium chloride, stannous chloride and dilute hydrochloric acid, and the polymeric substrate is then carefully rinsed. Thereafter, in accordance with this invention, the activated surface of the plastic is accelerated using particular molar concentrations of an inorganic acid, a metal salt preferably selected from the group consisting of nickel, cobalt and ruthenium and desirably a compound capable of ionizing to produce fluoride ions, that is, monovalent negative fluoride ions. The electroless plating procedure is then normally completed by a water rinse, and immersing or otherwise contacting the substrate surface with a chemical plating solution containing a reducible salt of the metal to be deposited on the surface, such as nickel, cobalt, copper or the like. The metalized surface is then rinsed with water and is now ready for conventional electroplating.

Acclerating a substrate surface after activation is of course a generally well-known procedure. The use of this step is theorized on the assumption that during activation of the substrate not only is palladium or another catalytic material laid down to provide the necessary initiating foci for the reduction of metal ions in the electroless plating solution, but excess stannous ions and/or other impurities which are also present in known activating solutions are also deposited on or at least adhere to the surface of the substrate, and more particularly, during the water rinsing subsequent to the activating step there occurs hydrolysis of palladous chloride and stannous choride which are entrained in microscopic cavities in the surface of the polymeric surstrate. These stannous ions in the form of stannous hydroxide, as well as other impurities, are deterrents to the subsequent deposition of metal, just as are residual adherent hexavalent chromium ions from the etching step. This removal of impurities is the primary function of the usual accelerating solution. The problem presented is one of promoting removal of these "poisons" preferentially to palladium hydroxide foci, which upon reduction become the catalyzing sites. The known accelerating solutions are quite effective in removing stannous ions, but their use is critical in that they must be accurately controlled in order to avoid also removing excess amounts of the palladium and thus impeding successful accomplishment of electroless plating.

It has been found by applicants that if there is employed an accelerating solution comprised of an inorganic acid in the amount of approximately 0.025 to 1.00 moles, a metallic salt desirably selected from the group consisting of nickel, cobalt and ruthenium, in an amount of about 0.002 to 0.2 moles, and in certain instances a compound capable of ionizing to produce monovalent negative fluoride ions, the latter compound being present in an amount of apporximately 0.004 to 0.6 moles, each of the above-mentioned problems and the disadvantages of prior art procedures are essentially completely overcome. To be more specific, by this invention excess stannous hydroxide is rapidly removed and the palladium hydroxide remains to perform an important catalytic function in the electroless plating step. Further, by proceeding in the manner herein disclosed, the stainless steel rack contacts are activated, that is to say, they are cleaned so that there is essentially no adsorbed metal oxides such as trace amounts of tin, and there remains on the rack contacts catalytic metal in the form of reduced nickel or cobalt, depending upon the particular mentioned metallic salts employed. Also, there is accomplished by this invention substantially complete removal of stannic hydroxide colloid $S_n(OH)_4$, which results from oxidation of stannous hydroxide by reason of the presence of oxygen in the air or in the water solution caused by air agitation in the rinsing step.

An exemplary activator solution comprises approximately 200 mg/1 palladium chloride ($PdCl_2$), about 13 g/1 $SnCl_2$ and 100 g/1 of hydrochloric acid. It is theorized that when these materials are combined the reaction product is substantially as follows:

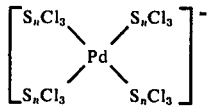

During the rinsing step following activation it is also postulated that there is formed:

$$PdCl_4^{-}$$

and $$S_nCl_4^{-} + {}_{HCl}$$

The water during rinsing also apparently reacts with the mentioned palladous chloride and stannous chloride in generally the following manner:

$$PdCl_4^{-} + 2H_2O \rightarrow Pd(OH)_2 + 4HCl$$
$$SnCl_4^{-} + 2H_2O \rightarrow Sn(OH)_2 + 4HCl$$

Relatively speaking, stannous hydroxide has approximately the same degree of solubility as palladium hydroxide, and it is apparently for this reason that prior attempts to accelerate the activated surface of the plastic by use of a dilute solution of an acid or alkali have not been completely successful.

As will be brought out in the examples to follow, a preferred accelerating solution contains from about 10 to 30 grams per liter of hydrochloric acid or a general concentration range of from about 3 to about 10% by volume, although this is not at all times critical, ½ to forty grams per liter of nickel chloride hexahydrate, and when required approximately one fourth to two grams per liter of sodium bifluoride ($NaHF_2$). However, for the acid there may be substituted fluoroboric acid ($HBF_4$) at about the same concentration or sulfuric acid at about the same concentration. The nickel chloride hexahydrate also can be replaced by cobalt chloride hexahydrate, ruthenium chloride, or any member from the platinum group of the Periodic Chart which has a reduction potential less than that of iron. The source of the fluoride ion could also be ammonium acid fluoride ($NH_4HF_2$), sodium fluoride (NaF), lithium fluoride (LiF), potassium fluoride (KF), fluosilic Acid ($H_2SiF_6$), hydrofluoric acid (HF) or any compound capable of ionizing to produce monovalent negative fluoride ions. The time for effecting acceleration of the activated plastic substrate is generally between about 30 seconds and 3 minutes, and the temperature range is approximately 115° to 140° F.

A wide variety of plastic materials can be treated in accordance with the novel concepts of this invention, such as polypropylene, phenolic, epoxy and polysulfone polymers as well as co-polymers such as acrylonitrile-butadiene-styrene (ABS), or any other usually chemically platable plastics. Particularly good results have been achieved to date with ABS and a polymer which is understood to be a combination of a polyaryl ether, ABS and a polysulfone, this being a product of Uniroyal Inc., identified by the trademark ARYLON.

A series of tests utilizing the instant novel composition were conducted as follows. An acidic accelerator containing 15 g/l hydrochloric acid and 1 g/l of nickel chloride hexahydrate had added thereto 200 ppm of bivalent tin in the form of stannous chloride, and when employing an immersion time of about 30 seconds at a temperature of between about 125° and 130° F, severe skipping or lack of continuity in the coverage of the substrate by the electroless deposited metal was noted. However, when about 2 g/l of sodium bifluoride was added, the accelerator solution was restored to normal operation. As stated previously, during water rinsing or an air transfer, a portion of the bivalent tin hydroxide retained on the plastic surface is oxidized to quadravalent tin hydroxide. It would normally be expected that the hydrochloric acid would dissolve the tin hydroxide, however, colloidal quadravalent tin hydroxide is relatively slow to react with the dilute hydrochloric acid present in the accelerator. Should the concentration of hydrochloric acid be increased, there will be removed not only the tin hydroxides, but palladium which is necessary as a catalyst in the electroless plating step. Thus, one aspect of this invention, there may be employed a compound cabable of ionizing to produce a source of fluoride ions to thereby promote rapid removal and dissolution of colloidal quadravalent tin hydroxide. Further, nickel ions or other metal ions which are capable of being reduced to the metallic state by an iron or stainless steel surface, that is, metal salts desirably selected from the group consisting of nickel, cobalt and ruthenium, act as catalysts for electroless nickel and when added to the acidic accelerator give an immersion deposit on the stainless steel contacts. This leaves the contacts active and allows electroless nickel to deposit on the contacts, as well as on the parts, thereby giving a low and uniform contact resistance. In another test, an acidic accelerator containing 15 g/l of hydrochloric acid and 1 g/l of nickel chloride hexahydrate had added thereto about 1 ppm quadravalent tin colloid, prepared by dissolving 1.45 grams of $SnCl_4 . 5H_2O$ in 500 ml distilled water. This solution was stable for 8 to 12 hours before stannic hydroxide particles separated out as an insoluble precipitate. Severe skipping resulted but when 2 g/l of sodium bifluoride was added, the solution was restored to normal operation. Thereafter, the addition of up to 5,000 ppm of quadravalent tin colloid did not interfere with the operation of the acidi accelerator.

In a further test an accelerator containing 15 g/l hydrochloric acid, 1 g/l nickel chloride hexahydrate and 1.84 g/l of ammonium acid fluoride had added thereto about 500 ppm of quadravalent tin colloid. Plastic test parts were run immediately, and the plating quality was excellent.

Additional runs were made, in the first the accelerator comprised 15 g/l HCl, 0.65 g/l HF and 1.0 g/l $NiCl_2 . 6H_2O$. In a further run the make-up was 15 g/l HCl, 40 g/l $NiCl_2 . 6H_2O$ and 1.84 g/l ammonium acid fluoride. The quality of plating on the parts in both runs was excellent.

It has been discovered by the applicants that at this point in the process cycle an important, although heretofore unrecognized, condition prevails. Consider a rack or work fixture carrying a multiplicity of plastic parts adjacent to one another, as is common in any commercial application of the art. If the metallized plastic parts are not of a relatively low and uniform level of electrical resistance with respect to the rack or work fixture, they begin to electroplate in conventional solutions in a distinctly particular manner. Parts exhibiting a low electrical resistance between their surface and the rack begin to plate very quickly, whereas those having a high resistance between their surfaces and the rack start to plate at a significantly decreased initial rate. It follows from this that the parts which begin to plate faster soon attain a much higher surface current density than those which start to plate more slowly. As a consequence of this, it may obtain that the effective electrical resistance for the induced bipolar charge distribution on the surface of a part of high resistance is considerably less than that resulting from the direct circuit connection to the cathodic pole of the electroplating power supply. It then logically follows from elementary physics that certain areas of the surfaces of the metallized plastic parts will be anodic with respect to the electrolyte, and the metallic coating thereon will be electrolytically dissolved. The result of this sequence of events will be the stripping of certain parts on the rack of their metallic coating and skipping or misplate subsequent to the complete electroplating processing. That such high and nonuniform part to rack resistances does occur when using only an inorganic acid as an accelerator, as is common in the prior art, is portrayed in attached Table I. It is the function then, in the instant invention, of a metal salt selected from the group consisting of nickel, cobalt and ruthenium in combination of the other ingredients herein disclosed to deposit by immersion on the stainless steel contacts a metallic film which is catalytic to and promotes the deposition of the subsequent electroless metallization step, in order that the electrical resistance between the plastic surface and the rack or work fixture is decreased to a low and uniform level. The effectiveness of this method is clearly demonstrated by the data included in attached Table II, wherein there is set forth the results of incorporating the instant invention into the total process cycle.

An acidic accelerator was prepared containing 15 g/l hydrochloric acid and 1 g/l nickel chloride hexahydrate. When incorporated into the total process cycle for plating on plastic, complete coverage was obtained. Then a solution of stannic colloid was prepared by dissolving 1.45 g/l stannic chloride pentahydrate in 500 ml of distilled water. This solution was stable for 8 to 12 hours before stannic hydroxide particles settled out as an insoluble precipitate. The addition of 1 ppm quadravalent tin colloid to the acidic accelerator caused severe skipping on test panels and parts. The addition of 2 g/l sodium acid fluoride returned the solution to normal operation. Thereafter, the addition of up to 5000 ppm of quadravalent tin colloid did not interfere with operation of the acidic accelerator or complete coverage on parts and panels.

TABLE I

| ELECTRICAL RESISTANCE IN OHMS | | | |
|---|---|---|---|
| ACCELERATOR TESTED | PART ON RACK | PART ONLY | CONTACT |
| 11.5 g/l HCl | 22 | 14 | 8 |
| 129° F. | 5000 | 14 | 4986 |
| 90 sec. | 24 | 14 | 10 |
| | 5000 | 14 | 4986 |
| | 21 | 12 | 9 |
| | 18 | 14 | 4 |
| | 16 | 14 | 2 |
| 31.5 g/l HCl plus | 5000 | 11 | 4989 |

TABLE I-continued

| ELECTRICAL RESISTANCE IN OHMS | | | |
|---|---|---|---|
| ACCELERATOR TESTED | PART ON RACK | PART ONLY | CONTACT |
| 18.4 g/l $HBF_4$ | 32 | 11 | 21 |
| 83° F. | 26 | 10 | 16 |
| 30 sec. | 68 | 10 | 58 |
| | 24 | 11 | 13 |
| | 20 | 11 | 9 |
| | 19 | 13 | 6 |
| 30.6 g/l $HBF_4$ | 25 | 12 | 13 |
| 117° F. | 5000 | 12 | 4988 |
| 60 sec. | 5000 | 12 | 4988 |
| | 26 | 12 | 14 |
| | 5000 | 12 | 4988 |
| | 170 | 12 | 158 |
| | 40 | 13 | 27 |

TABLE II

| ELECTRICAL RESISTANCE IN OHMS | | | |
|---|---|---|---|
| ACCELERATOR TESTED | PART ON RACK | PART ONLY | CONTACT |
| 11.5 g/l HCl | 10 | 9 | 1 |
| 0.5 g/l $NiCl_2 . 6H_2O$ | 9 | 8 | 1 |
| 130° F. | 10 | 9 | 1 |
| 60 sec. | 10 | 9 | 1 |
| | 11 | 9 | 2 |
| | 9 | 9 | 0 |
| | 6 | 6 | 0 |
| 11.5 g/l HCl | 16 | 12 | 4 |
| 0.140 g/l $PdCl_2$ | 22 | 12 | 10 |
| 125° F. | 14 | 12 | 2 |
| 60 sec. | 12 | 12 | 0 |
| | 14 | 12 | 2 |
| | 14 | 13 | 1 |
| | 15 | 14 | 1 |
| 18 g/l HCl | 11 | 8 | 3 |
| 1 g/l $CoCl_2 . 6H_2O$ | 9 | 9 | 0 |
| 132° F. | 12 | 9 | 3 |
| 90 sec. | 10 | 10 | 0 |
| | 11 | 10 | 1 |
| | 10 | 10 | 0 |
| | 10 | 9 | 1 |
| 22.5 g/l HCl | 14 | 10 | 4 |
| 4 g/l $NiCl_2 . 6H_2O$ | 16 | 10 | 6 |
| 134° F | 15 | 11 | 4 |
| 30 seconds | 13 | 11 | 2 |
| | 15 | 10 | 5 |
| | 11 | 10 | 1 |
| | 10 | 10 | 0 |
| 15 g/l HCl | 7 | 7 | 0 |
| 1 g/l $NiCl_2 . 6H_2O$ | 7 | 7 | 0 |
| 1 g/l $NH_4HF_2$ | 8 | 8 | 0 |
| 124° F. | 9 | 8 | 1 |
| 30 seconds | 11 | 9 | 2 |
| | 8 | 8 | 0 |
| | 10 | 9 | 1 |

| | |
|---|---|
| $NaHSO_4$ | 95.6 g/l |
| NaCl | 20.0 g/l |
| $NiCO_3$ | 1.2 g/l |

This accelerator, used in the complete process cycle yield complete coverage on parts and panels. The addition of up to 2000 ppm quadravalent tin colloid did not interfere with operation of the solution. The addition of 1.8 g/l sodium acid fluoride had no deleterious effect on the quality of the work processed through this solution.

To Illustrate the invention further, a solution of 5% by volume of HCl (22 g/l HCl) was prepared and utilized at 110° F for 30 seconds as an acidic accelerator in a normal cycle for the metalization of ABS plastic parts. A rack of 7 plastic parts was processed, and the ohmic resistance was measured between the phase of the part and rack and between the back and front of the part only. Resistances, in ohms, were as follows:

| Part to Rack | Part Only |
|---|---|
| 30 | 1 |
| 70 | 1 |
| 80 | 1 |
| 2 | 1 |
| 1 | 1 |
| 1 | 1 |
| 1 | 1 |

Thereafter, 100 mg/l of ruthenium chloride, $RuCl_3$, (0.1 g/l $RuCl_3$) was added to the above solution and a identical test conducted. In this case, the ohmic resistance for each part to rack was measured to be one ohm, the same as the resistance on the part only. The use of $RuCl_3$ in the acidic accelerator decreased the contact resistance to essentially zero. As is appreciated to those skilled in the art, the contact resistance represents a difference between the "part on rack" and "part only".

It may be seen from the foregoing that applicants have provided an accelerator solution and method of treating a plastic substrate therewith whereby there is effectively removed excess stannous ions in a rapid fashion while leaving behind the palladium ions for catalysis in the electroless plating step. Further, by the presence of nickel ions or other metal ions that act as catalysts for electroless nickel, there is obtained an immersion deposit on the stainless steel contacts which leaves them active and permits the deposition of electroless nickle on the contacts, as well as on the parts, thereby giving a low and uniform contact resistance. The accelerator and process of this invention can be used with the wide variety of plastic parts, and as has been noted, there are a number of inorganic acid substitutes as well as variations in the metal salts which are capable of being reduced to the metallic state by iron or stainless steel surfaces and which are generally taken from the group consisting of nickel, cobalt and ruthenium. Additionally, many compounds capable of ionizing to produce fluoride ions have been mentioned. These and other changes may of course be practiced without departing from the spirit of the invention or the scope of the subjoined claims.

What is claimed is:

1. A method of treating polymeric plastic substrate prior to plating on a surface thereof, which comprises etching the substrate in an aqueous acid bath, activating the substrate surface by contact with an acidic tin-palladium complex activator, rinsing the activated surface with an aqueous medium and thereby forming on said surface tin palladium hydroxides, and accelerating said activated and rinsed surface with a solution comprising about 10 to 30 grams per liter of HCl, approximately ½ to 40 grams per liter of $NiCl_2 .6H_2O$ and about ¼ to 2 grams per liter of $NaHF_2$.

2. A plastic treating method as defined in claim 1, in which during the accelerating step the substrate is contacted by the solution for between 50 seconds and three minutes and the solution is maintain at a temperature between approximately 150° and 140° F.

* * * * *